US006224435B1

(12) United States Patent
Freitag et al.

(10) Patent No.: US 6,224,435 B1
(45) Date of Patent: May 1, 2001

(54) INLET STRUCTURE FOR WATER JET APPARATUS MOUNTED TO BOAT HULL

(75) Inventors: Michael W. Freitag; Paul E. Westhoff, both of Kenosha, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/469,940

(22) Filed: Dec. 24, 1999

(51) Int. Cl.[7] ..... B63H 11/01
(52) U.S. Cl. ..... 440/38; 440/46
(58) Field of Search ..... 440/38, 46, 47

(56) References Cited

U.S. PATENT DOCUMENTS

| | | | | |
|---|---|---|---|---|
| 3,109,407 | | 11/1963 | Dorst | 115/14 |
| 3,572,281 | | 3/1971 | Becker | 115/37 |
| 5,700,169 | * | 12/1997 | Jones | 440/46 |
| 5,713,768 | * | 2/1998 | Jones | 440/38 |
| 5,752,864 | | 5/1998 | Jones et al. | 440/41 |

FOREIGN PATENT DOCUMENTS

| | | |
|---|---|---|
| 262306 | 5/1963 | (AU) . |
| 481788 | 1/1970 | (CH) . |
| 1321564 | 2/1963 | (FR) . |
| 724662 | 11/1966 | (IT) . |

* cited by examiner

*Primary Examiner*—Stephen Avila
(74) *Attorney, Agent, or Firm*—Dennis M. Flaherty

(57) ABSTRACT

A marine craft has with an inlet ramp, which increases in height as the inlet ramp extends rearward, and a cavity which communicates at its front with the rear of the inlet ramp. The cavity is open at its bottom and its rear. The marine craft is propelled by a jet pump apparatus having an inlet housing which is installed in the aforementioned hull cavity. The inlet housing defines an inlet volume in flow communication with the inlet ramp and a water tunnel in flow communication with the inlet volume. The inlet volume has a height which increases as it extends rearward. The inlet ramp and the inlet housing each have a lower U-shaped boundary, which boundaries are connected to form a generally rectangular inlet for water being sucked in by the water jet.

23 Claims, 9 Drawing Sheets

| FIG.4A | FIG.4B |
|---|---|

APPROVED BY DRAFTSMAN | CLASS | SUBCLASS

INLET STRUCTURE FOR WATER JET APPARATUS MOUNTED TO BOAT HULL

FIELD OF THE INVENTION

This invention generally relates to water jet apparatus for propelling boats and other watercraft. In particular, the invention relates to inlet structures for guiding water into a water jet apparatus.

BACKGROUND OF THE INVENTION

It is known to propel a boat or other watercraft using a water jet apparatus mounted to the hull, with the powerhead being placed inside (inboard) the hull. The drive shaft of the water jet apparatus is coupled to the output shaft of the inboard motor. The impeller is mounted on the drive shaft and housed in a jet propulsion duct or water tunnel.

To facilitate use of water jet-propelled boats in shallow water, it is known to mount the water jet at an elevation such that the water jet does not project below the bottom of the boat hull. This can be accomplished, for example, by installing a duct in the stern of the boat, the duct being arranged to connect one or more inlet holes formed in the bottom of the hull with an outlet hole formed in the transom. The water jet is then installed outside the hull in a position such that the water jet inlet is in flow communication with the duct outlet at the transom. Such a system is shown in Australian Patent Specification No. 262306, published in 1963. Alternatively, the water jet can be installed inside the duct built into the hull, as shown in U.S. Pat. No. 5,181,868.

In another type of design, a water jet apparatus is installed inside the hull and penetrates the transom. An inlet housing of the water jet has a horizontal opening and an inclined water tunnel for guiding water to the impeller. The horizontal opening of the inlet housing is mounted in a hole in the bottom or near the bottom of the hull. A similar design is disclosed in Swiss Patent No. 481788.

There is a need for a boat design in which a water jet apparatus can be easily installed in a cavity formed in the hull, and in which the water tunnel of the water jet is elevated above the hull bottom.

SUMMARY OF THE INVENTION

The present invention is directed to a marine craft (e.g., a boat) propelled by water impelled through a duct, the inlet of which is situated below the boat waterline. A first portion of the duct comprises an inlet ramp formed in a hull of the boat, while a second portion of the duct is formed in an inlet housing of the propulsion apparatus, the inlet housing being installed in a hull cavity. The second portion of the duct is in flow communication with the first duct portion. The propulsion apparatus comprises an impeller rotatably mounted inside a third portion of the duct for impelling water rearward toward the duct outlet. The third portion of the duct is in flow communication with the second duct portion. The duct inlet is formed in part by a lower boundary of the inlet ramp formed in the hull and in part by a lower boundary of the inlet housing. In accordance with the preferred embodiment, each lower boundary has a U-shape. Preferably, the hull is made of non-metallic material (e.g., fiberglass) and the inlet housing is made of metal (e.g., aluminum alloy).

In accordance with a further aspect of the invention, a marine craft comprises a hull having a first plurality of hull sections defining an inlet ramp which increases in height as the inlet ramp extends rearward, and a second plurality of hull sections defining a cavity which communicates at its front with the rear of the inlet ramp. The cavity is open at its bottom and its rear. The marine craft further comprises a jet pump apparatus comprising an inlet housing installed in the aforementioned cavity in the hull. The inlet housing defines an inlet volume in flow communication with the inlet ramp and a water tunnel in flow communication with the inlet volume. The inlet volume has a height which increases as it extends rearward. In accordance with a preferred embodiment, the first plurality of hull sections comprise a first set of boundaries which form a first lower boundary and the inlet housing comprises a second lower boundary. The first and second lower boundaries define the water inlet.

In accordance with a further aspect, the invention is directed toward a water jet apparatus comprising a housing having a duct with an inlet and an outlet, and an impeller rotatably mounted to said housing and comprising a plurality of blades extending across respective portions of the duct. The duct inlet is formed by a first U-shaped boundary of the housing lying in a first plane and connected at endpoints to a second U-shaped boundary of the housing lying in a second plane. The first and second planes are not mutually parallel. Preferably, the first and second planes are generally mutually perpendicular. The housing may comprise an inlet housing, a stator housing in flow communication with the inlet housing and an exit nozzle in flow communication with the stator housing.

In accordance with another aspect, a boat hull comprises a first plurality of hull sections defining an inlet ramp which increases in height as it extends rearward from a beginning to an end, and a second plurality of hull sections defining a cavity which communicates at its front with the end of the inlet ramp. The cavity is open at its bottom and its rear, and has a width greater than the width of the inlet ramp and a height greater than the height of the inlet ramp at its end.

DETAILED DESCRIPTION OF THE PREFERRED EMBODIMENTS

Figure 1:
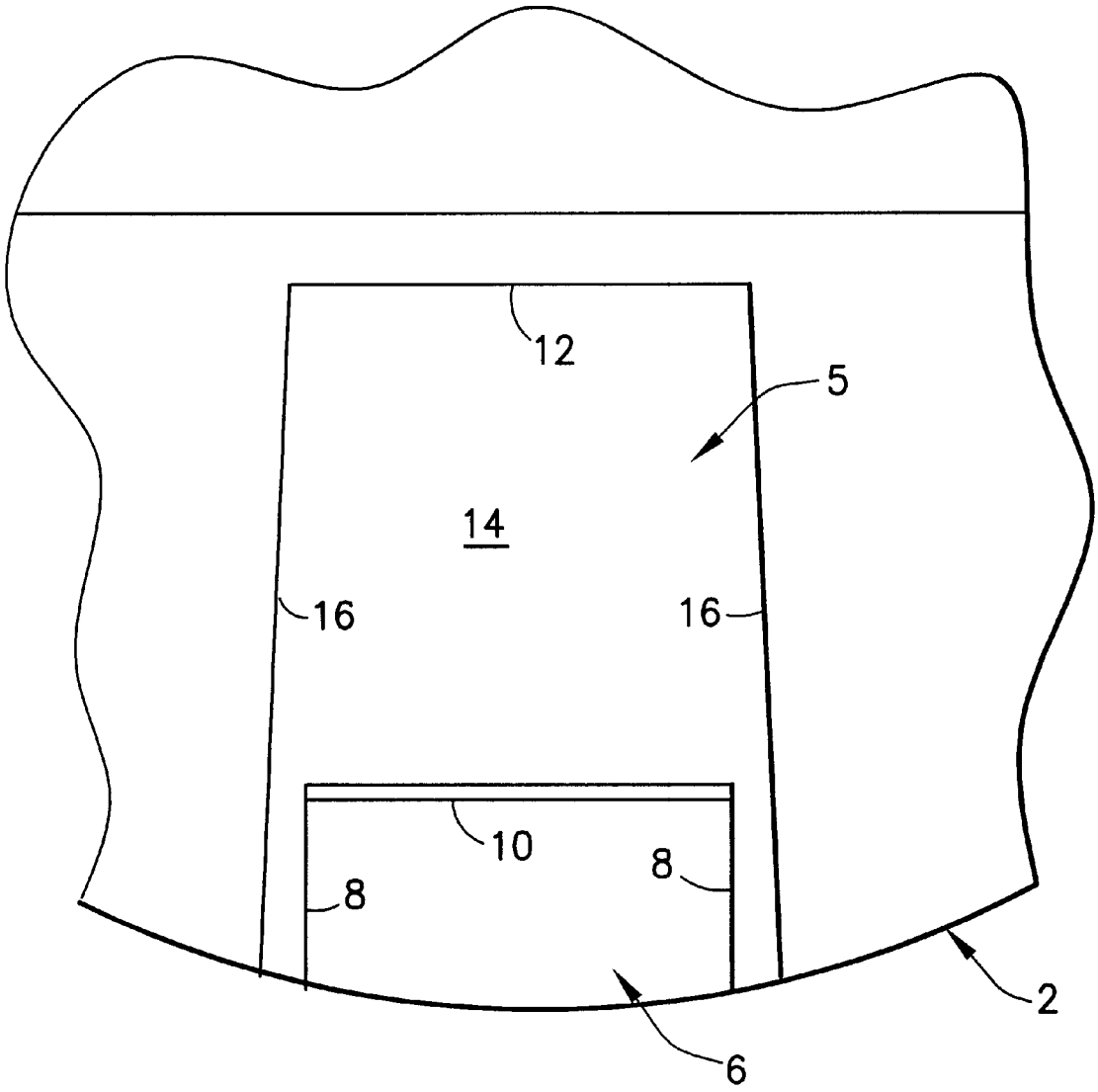
FIG. 1 is a schematic showing a rear view of a boat hull in accordance with the preferred embodiment of the invention.
Figures 2, 2A, 2B:
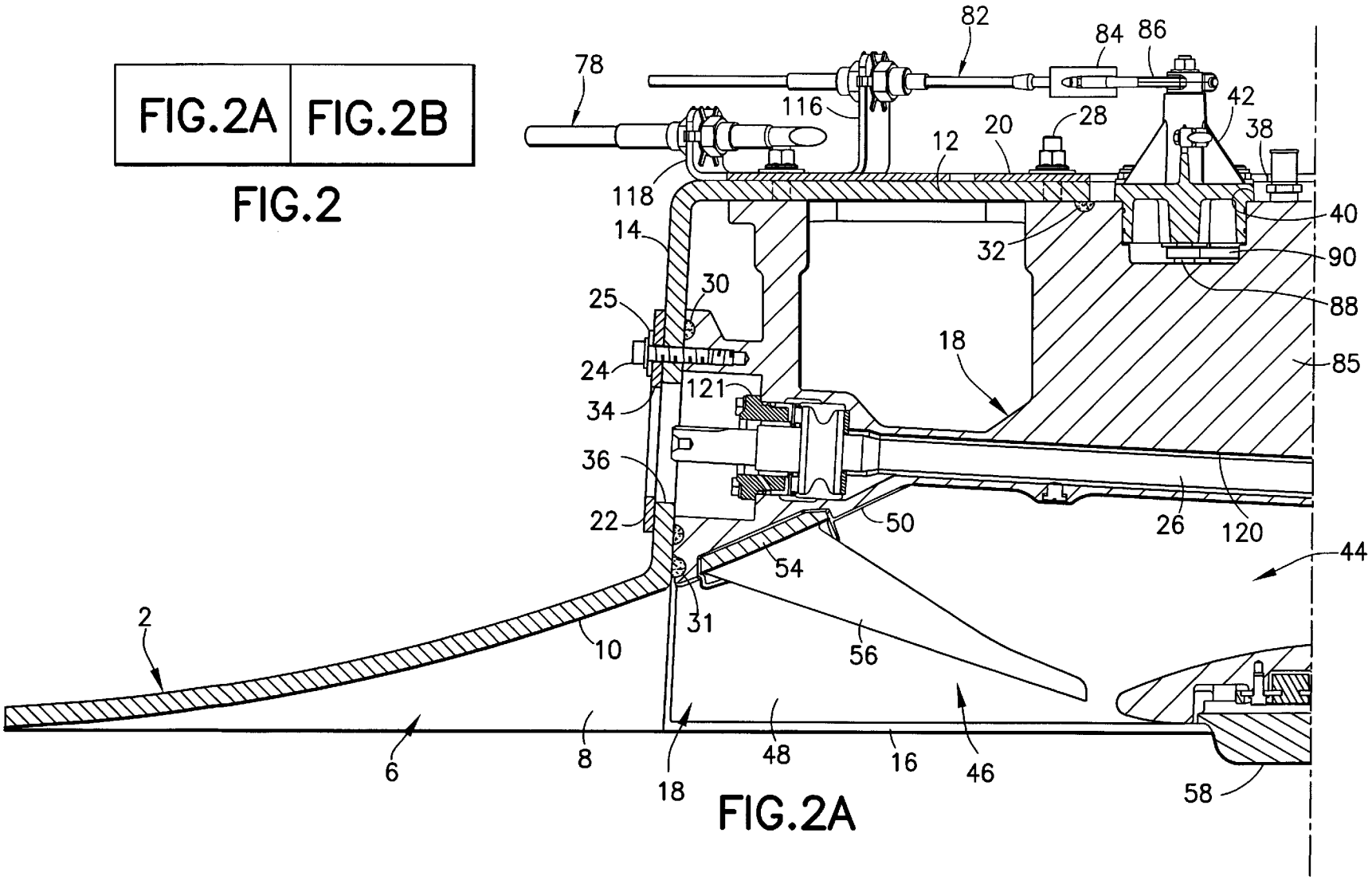
FIG. 2 is a schematic (presented in two sheets respectively labeled FIGS. 2A and 2B) showing a sectional view of a water jet apparatus mounted to a boat hull in accordance with the preferred embodiment of the invention, the section being taken along a vertical midplane.
Figure 2B:
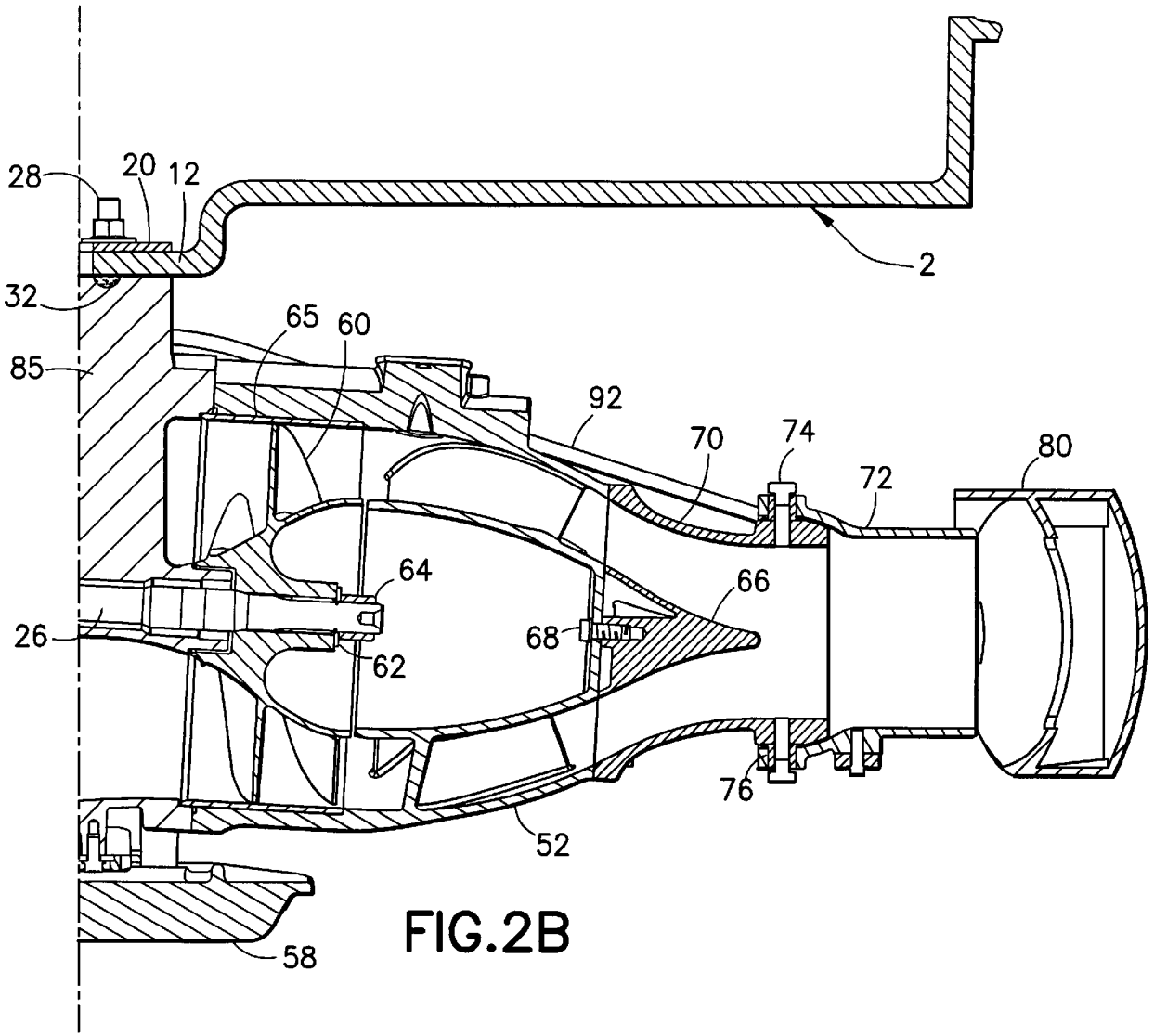

As seen in FIG. 1, the hull 2 has an inlet ramp 6 which increases in height as it extends rearward from a beginning point to an end point. The inlet ramp 6 is defined by a pair of opposing sidewalls 8 and a ramp surface 10 having lateral edges respectively connected to sidewalls 8. As best seen in FIG. 2A, the ramp surface 10 curves continuously upward from beginning to end. As seen in FIG. 1, at the rear end, the inlet ramp 6 has a boundary in the shape of a wide inverted U. The inlet ramp 6 communicates with a cavity 5 in which the water jet apparatus is installed. This cavity for the water jet apparatus is defined by a generally horizontal hull section 12, a generally vertical hull section 14 and a pair of opposing sidewalls 16, the cavity being open at the bottom and rear for allowing insertion of the water jet apparatus. Preferably, the sidewalls are not mutually parallel. In particular, each sidewall 16 is preferably disposed at an angle of a few (e.g., 3) degrees away from vertical to facilitate insertion of the water jet apparatus. Cavity 5 has a width greater than the width of inlet ramp 6, and has a height greater than the height at the rear end of inlet ramp 6.

Referring to FIG. 2, the water jet apparatus comprises an inlet housing 18 which is slid into cavity 5 and bolted to the hull 2 by means of a top mounting plate 20 and a front plate 22. The sidewalls 16 of hull 2 (see FIG. 1) and the exterior side surfaces 138 of the inlet housing 18 (see FIG. 5) are inclined at a slight angle of a few degrees (e.g., 3°) relative to the vertical plane to facilitate insertion of the inlet housing. At the time of inlet housing installation, the drive shaft 26 is already rotatably mounted in the inlet housing. In particular, the inlet housing 18 comprises a vertical strut 85 having an axial bore 120 which houses a portion of the drive shaft. The drive shaft 26 is rotatably supported by bearings. The bearing assembly at the front end of the drive shaft 26 is housed in a bearing housing 121. The bearing housing 121 is fastened to the inlet housing by a plurality of screws which are screwed into threaded holes 124 (seen only in FIG. 5) in the inlet housing 18.

The front of the inlet housing 18 is attached to the vertical hull section 14 by means of a front plate 22 and a plurality of screws 24 (only one of which is visible in FIG. 1), which screw into corresponding threaded holes 126 (shown in FIG. 5) in the inlet housing. The numeral 25 in FIG. 2A denotes a washer placed between the head of screw 24 and the front plate 22. The front plate 22 has an opening 34 which, in the assembled state, is aligned with an opening 36 in the vertical hull section 14 to allow the output shaft (not shown) from the inboard motor to be coupled to the front end of the drive shaft 26. The top of the inlet housing is attached to the horizontal hull section 12 by means of a top mounting plate 20 and a plurality of studs 28.

During inlet housing installation, the front plate 22 is placed on the inside of the vertical hull section 14 and the inlet housing 18 is placed on the outside of vertical hull section 14, a set of three throughholes in the vertical hull section 14 and a set of three threaded holes 126 in the inlet housing 18 (see FIG. 5) being aligned with a set of three throughholes in the vertical hull section 14. Three screws 24 (only one of which is visible in FIG. 2A) are passed through the aligned throughholes and screwed into the threaded holes 126 (see FIG. 5) of the inlet housing 18. The numeral 25 in FIG. 2A denotes a washer placed between the head of screw 24 and the front plate 22. The front plate 22 has an opening 34 which, in the assembled state, is aligned with an opening 36 in the vertical hull section 14 to allow the output shaft (not shown) from the inboard motor to be coupled to the front end of the drive shaft 26. The studs 28 are affixed to the inlet housing 18. The inlet housing 18 is inserted into the hull cavity and the studs 28 are inserted into throughholes in the hull. The front plate 22 is then positioned and screws 24 are screwed into the inlet housing 18. The top mounting plate 20 is then placed over the studs 28 and secured to the hull using nuts and washers.

Figure 5:
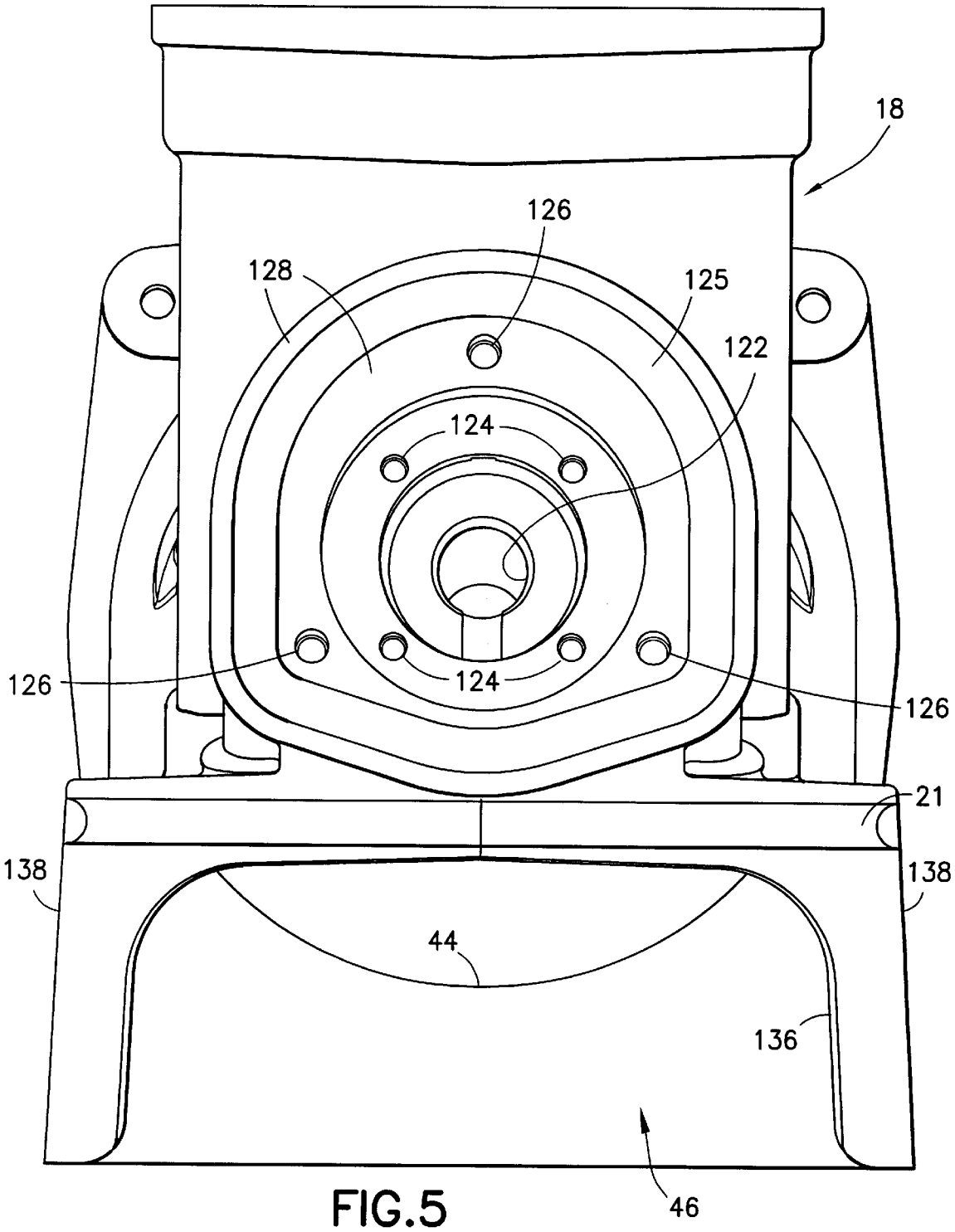
FIGS. 5–7 are schematics showing front, top and side views, respectively, of the inlet housing in accordance with the preferred embodiment of the invention.
Figure 6:
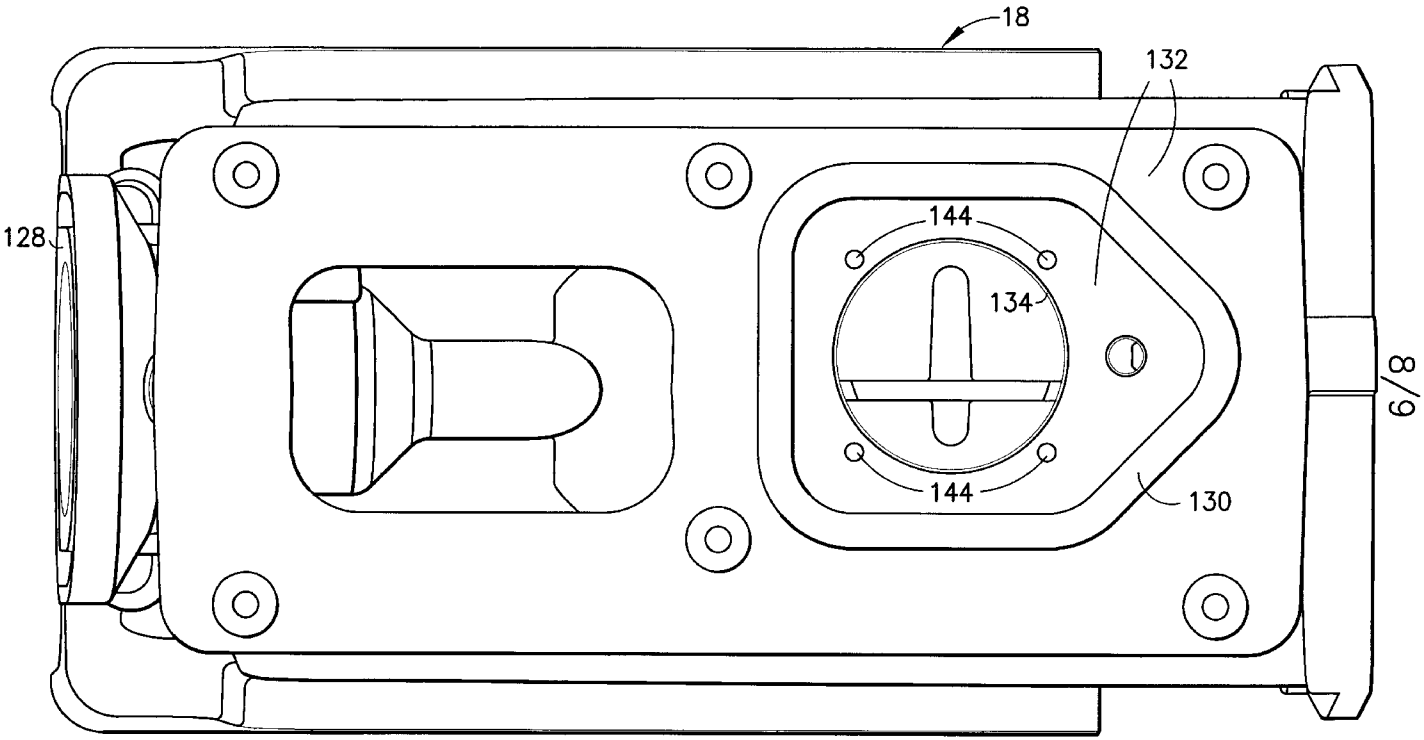
Figure 7:
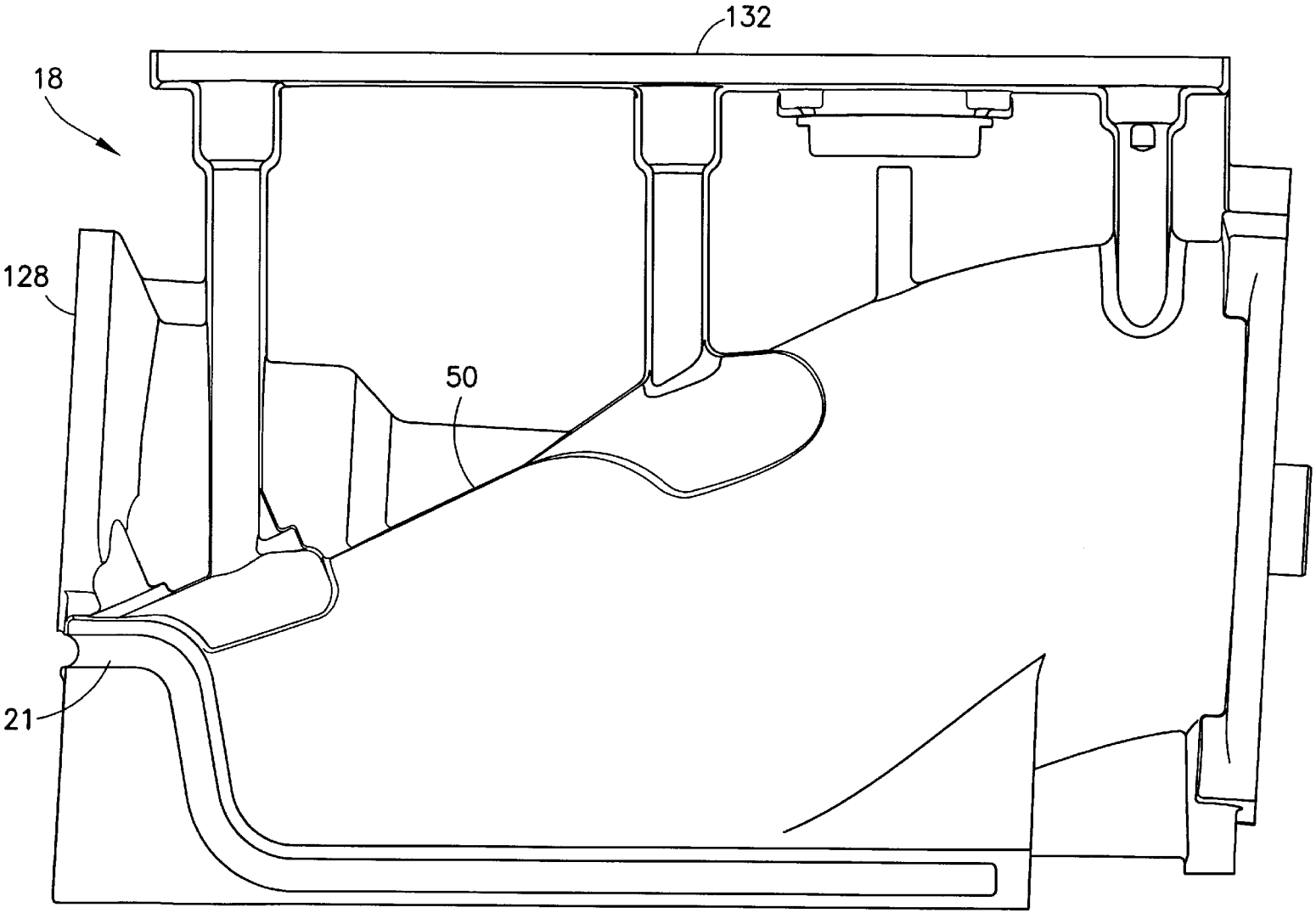

In the assembled position, a front portion of the inlet housing 18 is sealed against the vertical hull section 14 by means of a seal 30 and a top portion of the inlet housing 18 is sealed against the horizontal hull section 12 by means of a seal 32. The seal 30 sits in an endless recess 125 having a closed contour and formed in the slightly inclined front face 128 of the inlet housing, as seen in FIG. 5. The seal 30 encompasses the interface where the openings in the vertical hull section 14 and inlet housing for the drive shaft 26 meet and is designed to prevent water leaking into the drive shaft assembly or into the boat via the opening 36. Similarly, the top mounting plate 20 has an opening 38 which, in the assembled state, is aligned with an opening 40 in the horizontal hull section 12 to allow a shift and steering control housing 42 to be placed in a corresponding opening in the top wall of the inlet housing 18. The seal 32 sits in an endless recess 130 having a closed contour and formed in the horizontal top face 132 of the inlet housing, as seen in FIG. 6. The seal 32 encompasses the interface where the openings in the horizontal hull section 12 and inlet housing for the shift and steering housing 42 meet and is designed to prevent water leaking into the boat via the opening 38. In addition, a seal 31 is pressed between the inlet housing 18 and the hull along the front and sides of the inlet housing. The seal 32 sits in a recess 21 having a straight section formed in the front of the inlet housing 18, as seen in FIG. 5, and having contoured sections on the sides of the inlet housing 18, as seen in FIG. 7.

The inlet housing 18 has a duct comprising a water tunnel 44 and an inlet volume 46. The inlet volume lies between a pair of opposing sidewalls 48 (only one of which is shown in FIG. 2A) which are preferably generally coplanar with respective sidewalls 8 of the hull inlet ramp 6. In addition, the inlet volume is partly defined by a guide surface 50 which starts at a point slightly above where the ramp surface 10 of the hull inlet ramp 6 ends and then curves gradually upward in the rearward direction. As a result of the foregoing structure, there is a generally smooth transition between the end of inlet ramp 6 and the beginning of inlet volume 46.

Figure 3:
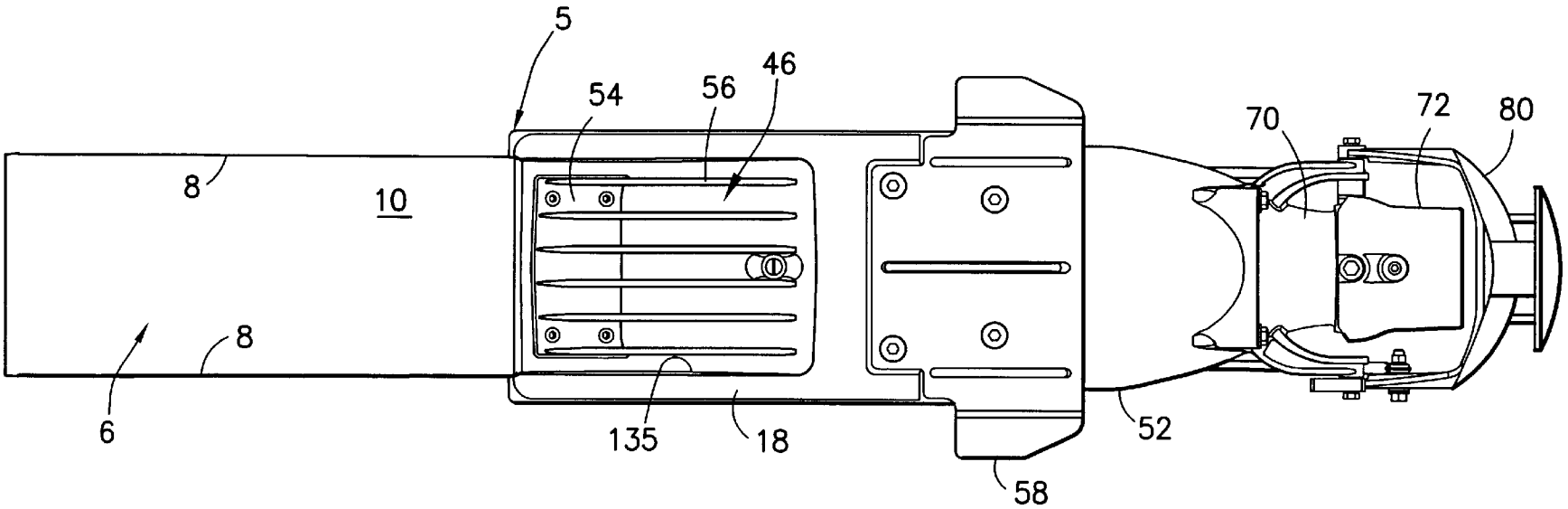
FIG. 3 is a schematic showing a bottom view of the water jet apparatus in accordance with the preferred embodiment of the invention.

As best seen in FIG. 3, the inlet ramp 6 of hull 2 and the inlet volume 46 of inlet housing 18 combine to form a single inlet for water sucked in by the impeller (not shown in FIG. 3). In the case where the lower boundary of the inlet ramp 6 is generally U-shaped and the lower boundary of the inlet volume 46 is generally U-shaped, the resulting inlet will be generally rectangular.

An inlet grate 54 extends across the inlet volume 46 and serves to block the admission of debris into the water tunnel. The inlet grate 54 comprises a multiplicity of generally parallel tines 56 which extend downward and rearward from an upper end of the inlet grate. Only the upper end of the inlet grate is attached to the inlet housing by screws (not shown). The cantilevered design is based on the theory that any weeds that wrap around the grate will be drawn down to the lower, open end and slide off under the boat and/or be drawn into the pump and chopped up. In addition, a ride plate 58 is attached to the bottom of the inlet housing 18.

Returning to FIG. 2, the drive shaft projects rearwardly out of the inlet housing 18. The impeller is preassembled in the unit prior to mounting in the hull. The hub and blades of impeller 60 are integrally formed as one cast piece. The hub of impeller 60 has a splined bore which meshes with splines formed on the external surface of the drive shaft 26, so that the impeller 60 will rotate in unison with the driveshaft. The impeller 60 is held securely on the drive shaft 26 by a washer 62 (shown in FIG. 2B), which in turn is held in place by a lock nut 64 tightened onto a threaded end of the drive shaft 26. As seen in FIG. 2B, the hub of the impeller 60 increases in radius in the rearward direction, transitioning gradually from a generally conical outer surface at the leading edge of the impeller hub to a generally circular cylindrical outer surface at the trailing edge of the impeller hub. This outer surface of the impeller hub forms the radially inner boundary for guiding the flow of water impelled by the impeller.

The stator housing 52 comprises inner and outer shells connected by a plurality of stator vanes, all integrally formed as a single cast piece. The hub of the stator housing 52 gradually decreases in radius in the rearward direction, starting out at a radius slightly less than the radius at the trailing edge of the impeller hub. The stator vanes are designed to redirect the swirling flow out of the impeller 60 into non-swirling flow. The stator housing hub has a radial end face with a central throughhole. Before the stator housing is installed, a tail cone cover 66 is attached to the radial end face of the stator housing hub by a screw 68. The front of the stator housing 52 is then attached to the rear of the inlet housing 18 by a plurality of screws (not shown).

A circumferential recess in the stator housing 52 at a position opposing the impeller blade tips has a circular cylindrical wear ring 65 seated therein. Wear to the impeller blade tips is mainly due to the pumping of abrasives such as beach sand. The purpose of the wear ring 65 is to protect the soft aluminum casting with a hard stainless steel surface, thus drastically reducing the rate of wear.

After the stator housing 52 (with attached tail cone cover 66) has been attached to the inlet housing 18, the front of an exit nozzle 70 is attached to the rear of the stator housing 52 by screws. The front faces of the tail cone cover 66 and the exit nozzle 70 are preferably coplanar. The water flowing out of the stator housing 52 will flow through the space between the tail cone cover 66 and the exit nozzle 70, and then will exit the exit nozzle at its outlet.

Figures 4, 4A:
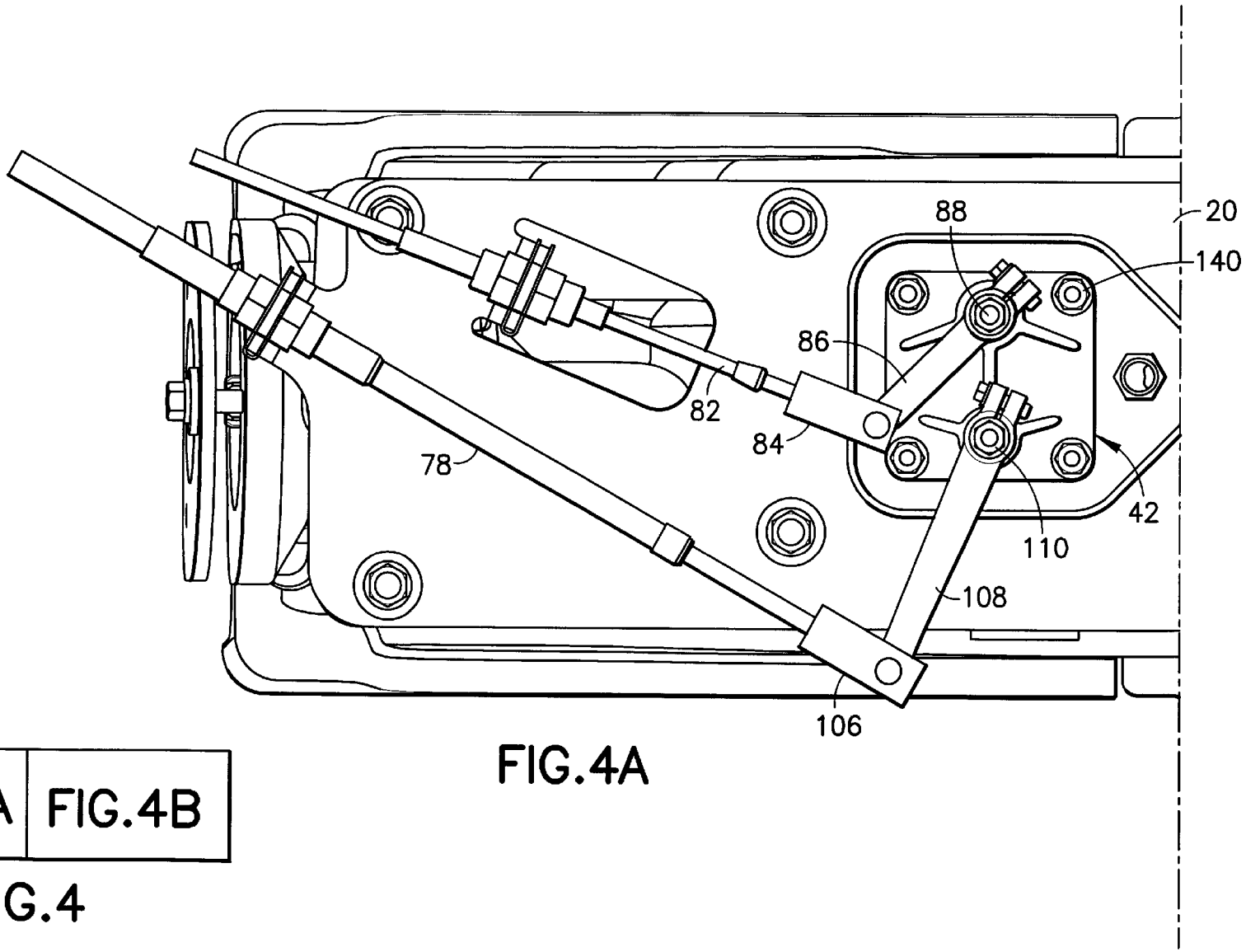
FIG. 4 is a schematic (presented in two sheets respectively labeled FIGS. 4A and 4B) showing a top view of the apparatus depicted in FIG. 2, with the hull removed.
Figure 4B:
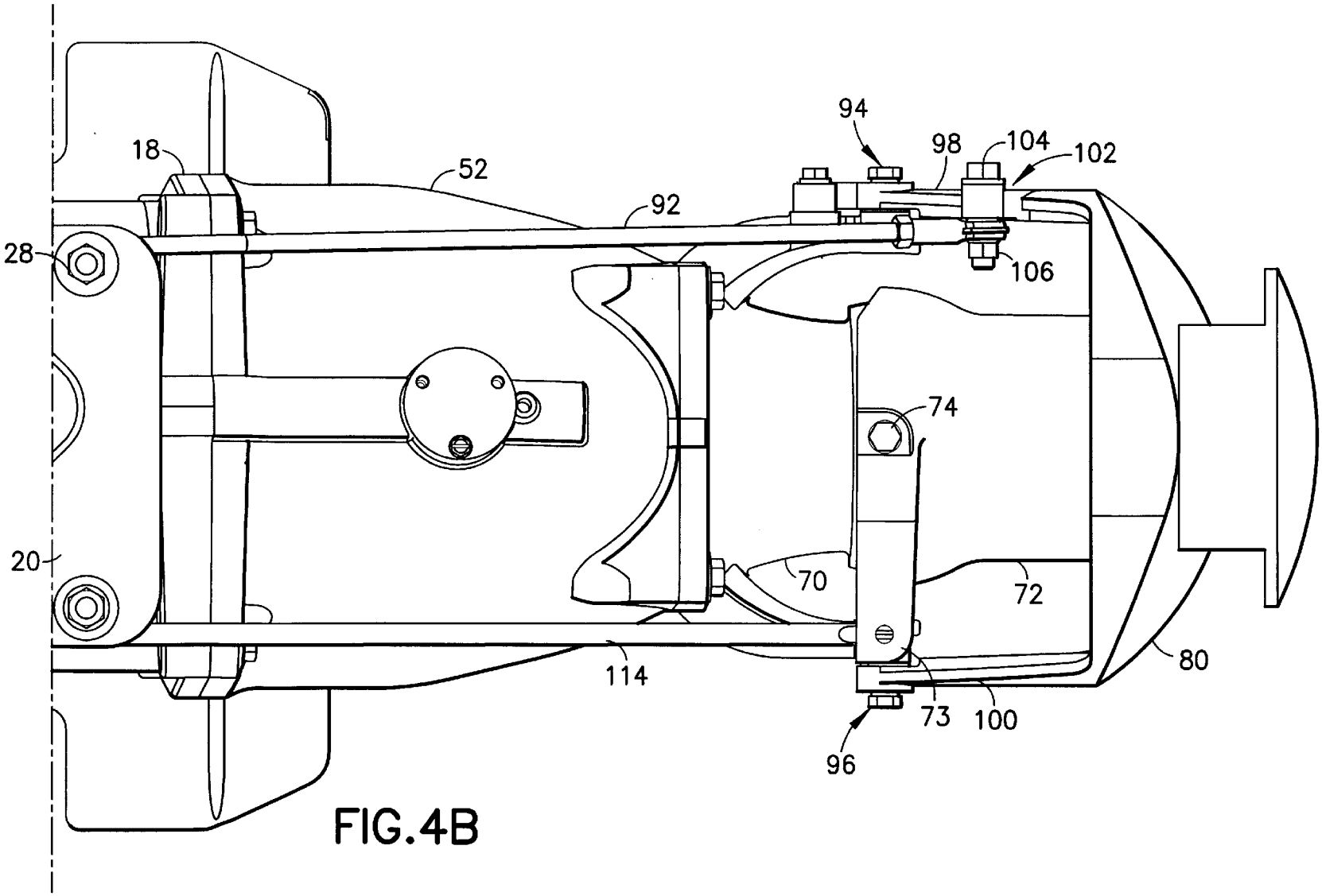

The water jet apparatus shown in FIG. 2 is provided with a steering nozzle 72 which can change the direction of the water exiting the exit nozzle 70. This effect is used by the boat operator to steer the boat left or right. To accomplish this, the steering nozzle 72 is pivotably mounted to the exit nozzle 70 by a pair of pivot assemblies located at the top and bottom of the exit nozzle. Each pivot assembly comprises a screw 74, a sleeve (not visible in FIG. 2B) and a bushing 76. The axes of the screws 74 are collinear and form a vertical pivot axis about which the steering nozzle 72 can rotate. In particular, the steering nozzle has a pair of circular holes in which the bushings 76 are seated. The sleeves are inserted inside the respective bushings 76. The screws 74 are in turn inserted in the sleeves and screwed into respective threaded holes in the exit nozzle 70. As best seen in FIG. 4B, the steering nozzle 72 has an arm 73 which is pivotably coupled to a flattened end of a steering rod 114. Displacement of the steering rod 114 in response to operation of a steering cable 78 (see FIG. 4A) causes the steering nozzle to swing a desired direction about its vertical pivot axis.

The water jet apparatus shown in FIG. 2 is also provided with a non-steerable reverse gate 80 which is pivotable between forward and reverse positions. In the forward position, the reverse gate 80 is raised, thereby allowing water to exit the steering nozzle 72 freely. In the reverse position, the reverse gate 80 is lowered to a position directly opposite to the outlet of the steering nozzle 72. The reverse gate is designed to partially reverse the flow of water exiting the steering nozzle 72 when the reverse gate is in the reverse position. This reverse flow of water will urge the boat in the rearward direction. To accomplish the foregoing, the reverse gate 80 is pivotably mounted to the exit nozzle 70 by a pair of pivot assemblies 94 and 96 located on opposite sides of the exit nozzle (see FIG. 4B). Each pivot assembly 94 and 96 has a construction substantially identical to the pivot assemblies previously described with reference to pivoting of the steering nozzle 72. As seen in FIG. 4B, the reverse gate has a pair of arms 98 and 100, the ends of which are pivotably coupled to the respective pivot assemblies 94, 96. The reverse gate 80 is pivoted by a shift rod 92, the end of which is coupled to arm 98 of the reverse gate 80 by means of a rod end assembly 102 which comprises a ball socket for allowing horizontal radial motion at the shift lever and vertical radial motion at the reverse gate. The rod end assembly is attached to arm 98 by means of a screw 104 and a lock nut 106. Displacement of the shift rod 92 in response to operation of a shift cable 82 (see FIG. 4A) causes the reverse gate to swing in a desired direction, namely, into forward position or reverse position. The reverse gate has a design which allows the boat to steer in reverse in the same direction like an outboard, stern drive or car.

In accordance with the preferred embodiment of the invention, the shift and steering cables located inside the hull are respectively coupled to the shift and steering rods located outside the hull by means of respective lever and shaft assemblies rotatably supported in a shift and steering control housing 42 which is installed in a corresponding circular opening 134 (see FIG. 6) in the top of the inlet housing 18. The opening 134 in the inlet housing communicates with the exterior of the water jet apparatus via a pair of opposing side channels through which lower shift and steering levers (not shown) respectively pass. Preferably the opening 40 (see FIG. 2A) in the horizontal hull section 12 closely matches the opening in mounting plate. As seen in FIG. 4A, the housing 42 is bolted to the inlet housing 18 by four studs 140. The studs 140 are threaded into respective threaded holes 144 formed in the top wall 132 of the inlet housing 18 (see FIG. 6).

As seen in FIG. 4A, the shift and steering control housing 42 rotatably supports a shift shaft 88 and a steering shaft 110. One end of an upper shift lever 86 is secured to the top of shift shaft 88; one end of an upper steering lever 108 is secured to the top of steering shaft 110. Referring to FIG. 2A, a lower shift lever 90 is welded to the bottom of shift shaft 88. Although not shown, a lower steering lever is welded to the bottom of the steering shaft 110. The distal end of the upper shift lever 86 is attached to a shift cable 82 by means of a clevis 84 and a clevis pin. These components are located inside the hull of the boat (see FIG. 2A). Displacement of the end of the shift cable causes the shift lever and shaft assembly to rotate. Likewise the distal end of the upper steering lever 108 is attached to the steering cable 78 by means of a clevis 106 and a clevis pin, and displacement of the end of the steering cable causes the steering lever and shaft assembly to rotate. As best seen in FIG. 2A, the shift cable 82 is supported by a bracket 116 and the steering cable 78 is supported by a bracket 118, both brackets being integrally connected to and extending vertically upward from the top mounting plate 20. In response to operation of the steering cable 78, the steering nozzle can be selectively turned left or right to steer the boat as desired during water jet operation. In response to operation of the shift cable 82, the reverse gate can be selectively raised or lowered to propel the boat forward or rearward as desired during water jet operation.

In accordance with the preferred embodiment of the invention, the front face 128 (see FIG. 7) forms an angle of 93° with the top face 132, with the axis of the drive shaft being perpendicular to front face 128. Thus the generally horizontal hull section 12 and the generally vertical hull section 14 (see FIG. 2A) also make an angle of 93°.

However, it will be apparent to a person skilled in the art that this angle can be varied.

Referring to FIGS. 3 and 5, it can be seen that the inlet housing in accordance with the preferred embodiment comprises an inlet formed by a first U-shaped boundary 136 lying in a generally vertical plane and a second U-shaped boundary 135 lying in a generally horizontal plane. When the inlet housing 18 is installed in the hull cavity 5, as seen in FIG. 3, boundary 135 and the lower boundary of the inlet ramp form an inlet for the water jet apparatus. The area bounded on three sides by boundary 136 (see FIG. 5) confronts the open end of the inlet ramp (best seen in FIG. 1) and allows water to exit the inlet ramp and flow into the inlet volume 46. Preferably the width of the area bounded by boundary 136 is generally equal to the width of the inlet, while the former's height is preferably slightly greater than the height of the inlet ramp at its open end.

Preferably the inlet housing is made of sand-cast aluminum, while the hull may be made of any conventional hull material, such as fiberglass, aluminum, polyethylene or other thermoplastic material.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "housing" comprises one or more assembled parts. For example, in the disclosed preferred embodiment, the inlet housing, stator housing and exit nozzle, when assembled, form a "housing". However, the present invention encompasses a housing comprising any number of parts for forming a duct with an inlet and an outlet. In addition, as used in the claims, the terms "generally horizontal" and "generally vertical" mean horizontal or nearly horizontal and vertical or nearly vertical, respectively.

What is claimed is:

1. A marine craft comprising:

a duct having an inlet and an outlet, said inlet being situated below a waterline; and an impeller rotatably mounted inside a first portion of said duct for impelling water rearward toward said outlet, wherein a second portion of said duct comprises an inlet ramp formed in a hull, and a third portion of said duct is formed in an inlet housing attached to said hull, said third portion of said duct being in flow communication with said first and second duct portions, and said inlet being formed in part by a lower boundary of said inlet ramp in said hull and in part by a lower boundary of said inlet housing, and said hull and said inlet housing are made of different materials.

2. The marine craft as recited in claim 1, wherein each of said lower boundaries is a U-shaped edge.

3. The marine craft as recited in claim 1, further comprising an inlet grate mounted inside said inlet housing, said inlet grate comprising a multiplicity of tines extending across said third duct portion.

4. The marine craft as recited in claim 1, further comprising a drive shaft rotatably mounted in said inlet housing.

5. The marine craft as recited in claim 1, wherein said inlet housing is installed in a cavity formed in said hull, said cavity being in communication with said inlet ramp.

6. The marine craft as recited in claim 5, wherein said hull comprises a pair of opposing sidewalls defining opposite sides of said cavity, wherein said sidewalls are not mutually parallel.

7. The marine craft as recited in claim 1, wherein said inlet ramp comprises a pair of opposing inlet ramp sidewalls and a ramp surface having sides respectively connected to said opposing inlet ramp sidewalls, wherein said ramp surface has a height which increases as said inlet ramp extends rearward from a beginning to an end.

8. The marine craft as recited in claim 1, wherein the widths of said second and third duct portions are generally equal at their interface, while the height of said third duct portion is slightly greater than the height of said second duct portion at said interface.

9. A marine craft comprising:

a hull comprising a first plurality of hull sections defining an inlet ramp which increases in height as said inlet ramp extends rearward from a beginning to an end, and a second plurality of hull sections defining a cavity which communicates at its front with said end of said inlet ramp, said cavity also being open at its bottom and its rear; and a jet pump apparatus comprising an inlet housing installed in said cavity in said hull, said inlet housing defining an inlet volume in flow communication with said inlet ramp and a water tunnel in flow communication with said inlet volume, wherein said inlet volume has a height which increases as said inlet volume extends rearward, wherein said first plurality of hull sections comprise a first set of boundaries which form a first lower boundary, said inlet housing comprises a second lower boundary, and said first and second lower boundaries define a water inlet.

10. The marine craft as recited in claim 9, wherein said first lower boundary is U-shaped, said second lower boundary is U-shaped, and first and second endpoints of said first lower boundary are respectively located adjacent first and second endpoints of said second lower boundary to define a generally rectangular water inlet.

11. The marine craft as recited in claim 9, wherein said first plurality of hull sections further comprise a second set of boundaries which form a rear boundary, said inlet housing further comprises a front boundary, and said rear and front boundaries are mutually adjacent.

12. The marine craft as recited in claim 10, wherein said first plurality of hull sections further comprise a second set of boundaries which form an inverted U-shaped rear boundary, said inlet housing further comprises an inverted U-shaped front boundary, and said rear and front boundaries are mutually adjacent.

13. The marine craft as recited in claim 11, wherein said rear and front boundaries lie in respective generally vertical planes.

14. The marine craft as recited in claim 9, wherein said first and second lower boundaries lie in a generally horizontal plane.

15. The marine craft as recited in claim 11, wherein the widths of said rear and front boundaries are generally equal, while the height of said front boundary is slightly greater than the height of said rear boundary.

16. The marine craft as recited in claim 9, wherein said second plurality of hull sections comprise first and second sidewalls which oppose each other, a generally horizontal hull section connected along opposing sides to said first and second sidewalls respectively, a generally vertical hull section connected along opposing sides to said first and second sidewalls respectively, said generally horizontal and generally vertical hull sections being connected along a generally horizontal line, and wherein said inlet housing is attached to said generally horizontal and generally vertical hull sections.

17. The marine craft as recited in claim 16, wherein said first and second sidewalls are not mutually parallel.

18. The marine craft as recited in claim 16, wherein said generally horizontal and generally vertical hull sections are not mutually perpendicular.

19. The marine craft as recited in claim 9, wherein said hull and said inlet housing are made of different materials.

20. The marine craft as recited in claim 9, further comprising an inlet grate mounted inside said inlet housing, said inlet grate comprising a multiplicity of tines extending across said inlet volume.

21. The marine craft as recited in claim 9, wherein said inlet ramp comprises a pair of opposing inlet ramp sidewalls and a ramp surface having sides respectively connected to said opposing inlet ramp sidewalls, wherein said ramp surface has a height which increases as said inlet ramp extends rearward from a beginning to an end.

22. A boat hull comprising a first plurality of hull sections defining an inlet ramp which increases in height as said inlet ramp extends rearward from a beginning to an end. and a second plurality of hull sections defining a cavity which communicates at its front with said end of said inlet ramp, said cavity also being open at its bottom and its rear, wherein said cavity has a width greater than a width of said inlet ramp and a height greater than the height of said inlet ramp at said end, wherein said second plurality of hull sections comprise first and second sidewalls which oppose each other, a generally horizontal hull section connected along opposing sides to said first and second sidewalls respectively, a generally vertical hull section connected along opposing sides to said first and second sidewalls respectively, said generally horizontal and generally vertical hull sections being connected along a generally horizontal line, and said first and second sidewalls being not mutually parallel.

23. The boat hull as recited in claim 22, wherein said generally horizontal and generally vertical hull sections are not mutually perpendicular.

* * * * *